United States Patent [19]

Vilotte et al.

[11] Patent Number: 4,603,809

[45] Date of Patent: Aug. 5, 1986

[54] PACKAGE WITH A BASE AND A COVER, ESPECIALLY FOR FOODSTUFFS SUCH AS EGGS

[75] Inventors: Alain Vilotte, Paris; Alain Jacquart, Ferriere la Grande, both of France

[73] Assignee: Seprosy Societe Europeenne pour la Transformation des Produits de Synthese, Paris, France

[21] Appl. No.: 703,887

[22] Filed: Feb. 21, 1985

[30] Foreign Application Priority Data

Feb. 24, 1984 [FR] France ..... 84 03332

[51] Int. Cl.[4] ..... B65D 1/00

[52] U.S. Cl. ..... 229/2.5 EC; 229/45 EC; 206/427; 220/306

[58] Field of Search ..... 229/45 R, 45 EC, 2.5 R, 229/2.5 EC; 206/427; 220/306

[56] References Cited

U.S. PATENT DOCUMENTS

| | | | |
|---|---|---|---|
| 3,034,693 | 5/1962 | Cox | 229/45 EC |
| 3,217,961 | 11/1965 | Hornbostel, Jr. | 229/45 EC |
| 3,623,650 | 11/1971 | Watts | 229/45 R |
| 3,968,921 | 7/1976 | Jewell | 229/45 R |
| 4,462,537 | 7/1984 | Grootherder et al. | 229/45 EC |
| 4,516,718 | 5/1985 | Forbes, Jr. | 229/45 R |

FOREIGN PATENT DOCUMENTS

| | | | |
|---|---|---|---|
| 2344468 | 3/1976 | France | 229/45 R |
| 207567 | 4/1966 | Sweden | 229/45 R |
| 248674 | 3/1926 | United Kingdom | 229/45 R |

*Primary Examiner*—Joseph Man-Fu Moy

*Attorney, Agent, or Firm*—Karl F. Ross; Herbert Dubno

[57] ABSTRACT

A food package for use with a UPC or bar code has a rectangular configuration with projections along its longitudinal edges received in openings of a flat cover member. Tongues project into these openings to brace against the undersides of these projections and hold the strips defined by longitudinal score lines of the cover member against the lateral flanks of the container so that a UPC or bar code on one of these strips can be scanned by a fixed-position reader without tilting or turning over the package.

12 Claims, 9 Drawing Figures

PACKAGE WITH A BASE AND A COVER, ESPECIALLY FOR FOODSTUFFS SUCH AS EGGS

FIELD OF THE INVENTION

Our present invention relates to a package of the type in which a cover is mounted upon a base or bottom member (container) and, more particularly, to a package for foodstuffs such as eggs which may be used in conjunction with bar code (UPC) scanning. More specifically the invention relates to an egg carton whose compartmented base may be composed of a translucent or transparent synthetic resin material and formed by thermoforming (drawing from plastic foil), the compartments of this base being shaped to receive the eggs. The base of the carton may be closed by a cover formed from a paper material such as pasteboard or cardboard.

BACKGROUND OF THE INVENTION

In modern supermarkets and in handling of foodstuff packages generally, increasing use is being made of so-called "bar codes", universal product codes (UPC) or EAN codes to identify the product, facilitate checkout and inventorying and to simplify the handling of the packages.

When foodstuffs such as eggs are provided in packages, it is possible to close the bottom of the package by a planar cover. While this may provide good visibility of the product, especially if the cover is transparent, it poses a problem if the bar code is to be applied to the planar upper surface since the passage of the package across the bar code reading will require that the package be turned over, an operation which may be detrimental to the contents.

The cover could, of course, be of the fitted type and provided with the code on a lateral susrface. Such fitted covers, however, are comparatively costly, difficult to position quickly and pose problems with respect to securing and removal.

OBJECTS OF THE INVENTION

It is, therefore, the principal object of the present invention to provide a covered container, especially for foodstuffs, which avoids the disadvantages outlined above.

Another object of our invention is to provide an egg package with a UPC bar code in a location in which it can be read without turning over the package and dislodging the contents thereof, but which nevertheless is of comparatively low cost and is easily fabricated and mounted.

Yet another object of this invention is to provide a simple cover assembly for an egg package or other compartmented package which facilitates identification of the package using fixedly positioned code readers.

SUMMARY OF THE INVENTION

These objects and others which will become apparent hereinafter are attained, in accordance with this invention, in a package, especially for foodstuffs, which comprises an upwardly open bottom (preferably a compartmented bottom whose individual compartments are intended to receive individual comestible units such as eggs) and a cover which closes the top of this bottom member.

According to the invention, the bottom member has outwardly projecting formations along opposite longitudinal upper edges thereof while the cover is formed from a plate or sheet of a rigid material whose length corresponds to the length of the longitudinal edges of the bottom member and whose width is greater than the width of the bottom member measured between these longitudinal edges or by the lengths of the transverse edges of the mouth of the bottom member.

The cover is formed with two fold lines extending longitudinally and parallel to one another at a distance from one another equal to the width of the bottom member so that the portion of the cover between these longitudinal fold lines closes the mouth of the container.

Along these fold lines, cutouts are provided into which the projections of the bottom member can extend and between each fold line and a respective longitudinal edge of the cover sheet, the cover sheet is formed with a flap which can be turned downwardly and inwardly along a corresponding flank of the bottom member and braced in this downwardly and inwardly turned position by a tongue projecting into the cutout and engaging the underside of the respective projection of the bottom member extending into this cutout.

Naturally the openings or cutouts along each londgitudinal fold line should correspond to the number of projections along the corresponding edge of the bottom member.

The downwardly and inwardly braced flaps are thereby able to be formed with identifying indicia, e.g. the UPC or bar code mentioned previously so that this can be scanned by even a fixed reader on a surface over which the container is moved with minimal or no tilting of the container.

The resulting cover is extremely simple and can be formed from a blank of any relatively rigid material, e.g. cardboard, in which the cutouts and tongues are formed by conventional die-cutting methods which also may provide the scoring defining the fold lines.

In practice, the projection can have a downwardly and outwardly extending flank beneath which a portion of a tongue can engage to form a detent or catch type of engagement of the cover. This detent type of engagement can ensure that the border strips which are bent downwardly along the flanks of the bottom member lie substantially perpendicular to the plane of the major portion of the cover closing the mouth of the container or can hold the border strips against an inwardly and downwardly extending flank or wall of the container. The engagement of the tongue with the projecting portions of the bottom member is made possible by the play which results by the bending of the edge strips along the score lines connecting the openings.

One or the other of the edge strips of the cover may be printed with a UPC bar code or with other indicia related to the contents such as a statement that the eggs contained therein are extra fresh and which can be torn away when the product has remained on the shelves for a time subsequent to an expiration date for a given quality characteristic. The tear-away portion can also be scored or die-cut with the formation of the openings and the fold lines.

The detent catch setting of the cover can be effected by positioning appropriate guide elements on the belt which carries away the product.

It is possible to arrange the catches so that the package can be opened only with difficulty or may be openable in a simple way. It is possible to provide the catch-setting device with a device for closing the container with the aid, for example, of a harpoon or barbed projection which, formed in the central part of the cover, also engages in catch fashion in orifices provided in the upper part of the container.

According to a feature of the invention, each opening is associated with a score line which is of circular arc curvature and is convex toward a respective edge of the cover.

Each opening can, moreover, be associated with two tongues of the same height projecting toward the center of the cover and adapted to be braced against the projecting portion of the bottom member of the container. The part turned toward the bottom can possess generally a U or V configuration turned downwardly.

According to another feature of the invention each opening is associated with at least two tongues of different heights, a higher one of which is intended to engage between the branches of the U or V of the projecting portion of the bottom member while the shorter tongue is adapted to brace beneath the projecting portion.

This arrangement has been found to be advantageous because the first tongue then provides a catch-type or positive lock of the cover while the second tongue provides the bracing action which holds the cover strip against the flank against the bottom member.

In another embodiment of this invention, each opening is provided with two tongues of different heights connected to one another by a transition zone of circular arc curvature, the relatively short tongue being designated to engage between the two branches of the U of the projecting part of the bottom member while the tongue of greater height can engage both branches of the U while remaining outside the latter to provide the bracing action. The engagement with the external branch of the U is effected by a point of the circular arc transition zone between the two projecting portions.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
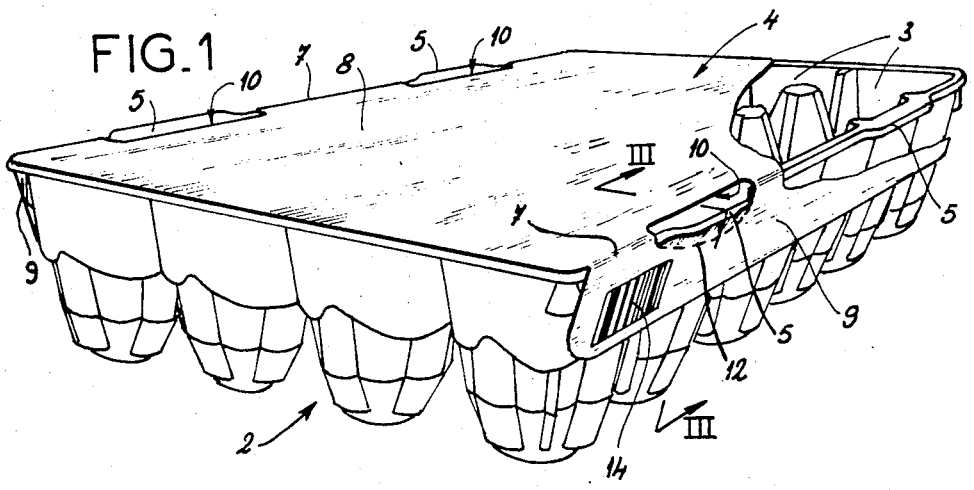
FIG. 1 is a perspective view, partly broken away, of an egg carton for two dozen eggs.

The package shown in FIG. 1 comprises an egg container 2, also referred to herein as a bottom member and composed of a transparent or translucent material, being obtained by the thermoforming of a thermoplastic foil in accordance with conventional techniques to provide twenty-four cells or compartments 3 each adapted to receive one egg.

The container 2 is closed by a cover 4.

As can be seen mainly from FIG. 1, the container 2 has, at its upper longitudinal edges, each two projecting portions 5 which extend parallel to the plane of the cover outwardly from the rectangular mouth thereof. Indeed, each of these parts 5 can be obtained by molding or bending a portion of the flat blank from which the container is drawn and is thermoformed with a downwardly inclined portion 6 imparting to the projecting portion 5 the cross section of a downwardly open U or V. The lateral flanks of the container 2 are inclined downwardly and inwardly.

The cover 4 is formed from a flat blank of cardboard by die-cutting and has a length corresponding to the length of the container 2 at its mouth and a width which is greater than the width of the container 2 at its mouth so that a pair of edge strips 9 can be defined along the longitudinal edges of the cover by the longitudinal score lines 7 which are parallel to one another and are spaced apart by a distance equal to the width of the container. The two score lines define between them a flat central portion 8 of the cover. The strips 9 can be bent downwardly to lie along the flanks of the package along the respective score lines 7.

Along each score line 7, the cover 4 is formed with two openings or windows 10 dimensioned to receive the respective projecting parts 5 of thes container 2.

The ends of each window 10 are connected by a further score line 12 which formed an arc of a circle and is bowed toward the edge of the respective strip.

Figure 2:
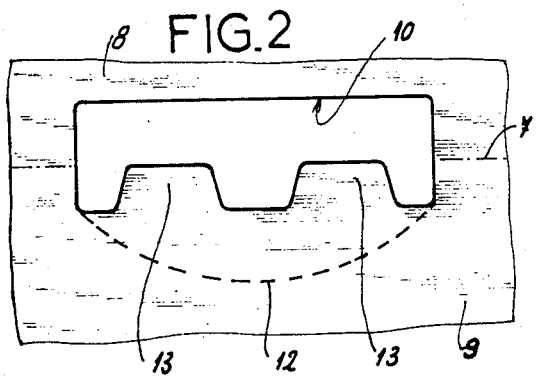
FIG. 2 is a view of a portion of the flat cover before it is applied to the container or bottom member.

In the embodiment shown in FIG. 2, the side of the window associated with the score line 12 is formed with two tongues 13 of the same height projecting toward the center of the window 10.

Figure 3:
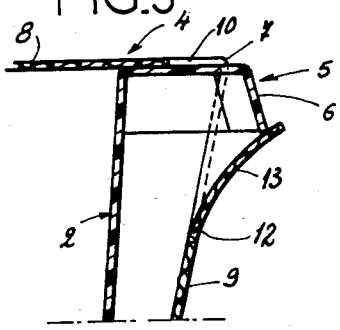
FIG. 3 is a section taken along the line III—III of FIG. 1.

When the cover is applied to the container 2, therefore, the tongues 13 can brace beneath projecting portion 5 (FIG. 3) and thereby hold the strip 9 against the respective flank of the container as shown in FIG. 1 so that an arch-like or bowed deformation takes place in the strip delimited by the score line 12 (FIG. 3). This not only holds the cover on the container, but ensures the inclined orientation of the strip 9 seen in FIG. 1 which carries the bar code or UPC 14 which may be previously printed thereon or affixed by an adhesive label or the like. The bar code is thus easily read by a fixed reader without the need to turn over the package.

FIGS. 4–9 show essentially similar elements and thus use the same reference numerals.

Figure 4:
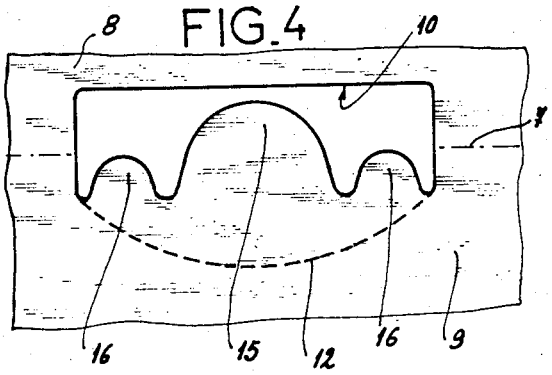
FIG. 4 is a view similar to FIG. 2 showing another arrangement of the tongues of the cover.
Figure 5:
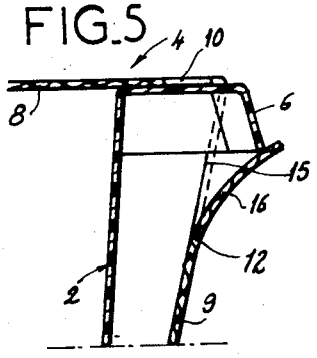
FIG. 5 is a view similar to FIG. 3 but applicable to the use of the cover shown in FIG. 4.

In the embodiment shown in FIG. 4, for example, the opening 10 is delimited along its outer edge by three tongues 15, 16, namely, a central tongue 15 which has a greater height and a pair of shorter tongues 16 flanking the central tongue 15. As can be seen from FIG. 5, the central tongue is dimensioned to engage between the branches of the U forming the projection 5 while the short tongues 16 function as leaf-springs which are bent arcuately and brace against the underside of the external branch of the U 6.

Figure 6:
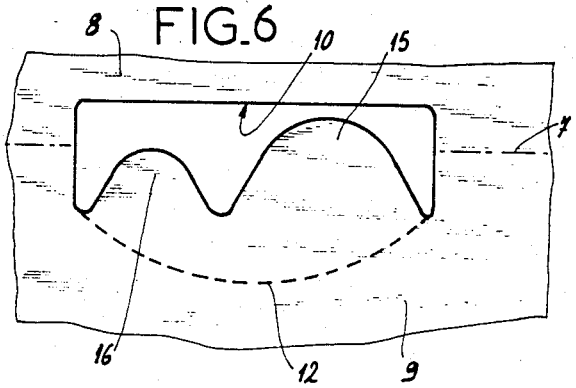
FIG. 6 is a view similar to FIG. 2 but illustrating an embodiment in which two rounded tongues of different heights are provided.
Figure 7:
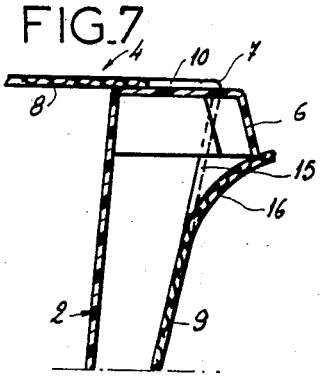
FIG. 7 is a section corresponding to FIG. 3 but of the embodiment of FIG. 6.

The embodiment of FIGS. 6 and 7 differs only in that two tongues 15, 16 are provided, the taller tongue 15 engaging in the U while the shorter tongue 16 is braced against the outer branch of the U.

Figure 8:
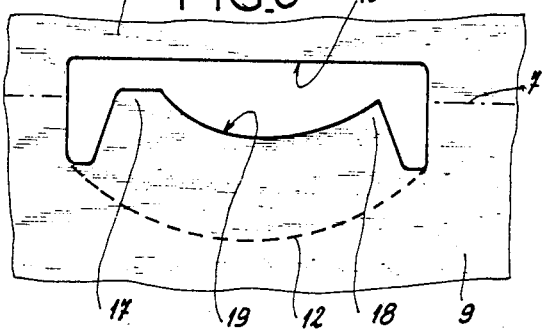
FIG. 8 is a view similar to FIG. 2 illustrating still another embodiment of the cover of the invention.
Figure 9:
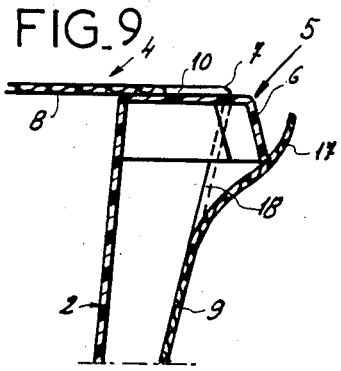
FIG. 9 is a section corresponding to FIG. 3 of this latter embodiment.

In the embodiment shown in FIG. 8, the opening 10 is delimited along its side turned toward the edge of the cover by a pair of tongues 17 and 18 of different heights connected by a zone 19 having the configuration of a circle arc which is concave inwardly or convex outwardly. In this case the tongue 17 has a height such that it cannot engage beneath the outer edge of the U shown at 6 and thus is braced against this branch, while the edge 18 forms a catch engaging within the U and a point of contact is provided between the lower edge of member 5 and the arc 19 between two tongues.

The resulting package is simple and economical and permits application of the bar code to a portion of a lateral wall which is easily read without turning over the container. Indeed, in all of the embodiments described, it is not necessary to even tilt the package for most readers and if some tilting is required, the tilting can be minimal.

If viewing of the contents through the cover is required, a flap or the like can be provided on the cover by die-cutting so that this flap can be pulled up to allow viewing of the contents without opening the catches.

To remove the cover, moreover, one need not lift the latter at each projection 5 or window 10, but can simply tear away a portion specifically designed or scored for this purpose at one of the windows 10. If a tear-away or tab portion is provided, it may extend along the upper face of one of the parts 5, 6 toward the edge of the cover and remain attached to the central part of the cover by its edge connection therewith. During the mounting of cover, the tab lies on the upper face of one of the parts 5 projecting from the edge of the bottom member.

We claim:

1. A package comprising:

a rectangular container having an upwardly open mouth formed with a pair of longitudinal edges and a pair of transverse edges, each of said longitudinal edges being formed along a rim of a respective longitudinal wall each of which is provided along the respective longitudinal edge with at least one outwardly extending projection, said longitudinal walls diverging upwardly and outwardly toward said mouth;

a cover extending over said mouth and composed of a flat relatively stiff material, said cover being formed with a pair of mutually parallel fold-score lines spaced apart by a distance greater than the lengths of said transverse edges, said cover being of a width greater than the width of said mouth whereby said cover has strips along its opposite longitudinal edges delimited by said fold-score lines, each of said fold-score lines being formed with a window adapted to receive a respective one of said projections; and respective tongues projecting from each of said strips into the respective windows and adapted to be braced against an underside of the respective projection to hold the respective strip in a downwardly and inwardly inclined orientation generally along a respective one of said longitudinal walls of said container.

2. The package defined in claim 1 wherein at least one of said strips is provided with a bar code identifying contents of said package.

3. The package defined in claim 1 wherein each of said windows is provided with a score line of circular arc curvature convex away from the respective window and connecting opposite ends thereof.

4. The package defined in claim 1 wherein an edge of each window turned toward a respective strip has a plurality of tongues engagable with the respective projection.

5. The package defined in claim 4 wherein each of said projections has a downwardly open channel, at least one of said tongues engaging in said channel while another tongue is braced against an outer side of the respective channel.

6. The package defined in claim 5 wherein said channel has the configuration of a downwardly open V.

7. The package defined in claim 5 wherein said channel has the configuration of a downwardly open U.

8. The package defined in claim 7 wherein the tongues engagable with each projection have different heights, the taller tongue engaging between the branches of the U and a shorter tongue engaging an outer branch of the U.

9. The package defined in claim 7 wherein said tongues have different heights, the shorter tongue engaging between the branches of the U and the taller tongue being braced against the outer branch of the U.

10. The package defined in claim 7 wherein said tongues are of different heights and are connected by a transition region of circular arc configuration, an edge of an outer branch of the U engaging said transition region.

11. The package defined in claim 1 wherein said container is compartmented.

12. The package defined in claim 11 wherein said container is transparent and shaped with respective cells each adapted to receive an egg, at least one of said strips carrying a bar code.

* * * * *